US010633822B2

(12) United States Patent
Olandese

(10) Patent No.: US 10,633,822 B2
(45) Date of Patent: Apr. 28, 2020

(54) SEDIMENT CLASSIFICATION SYSTEM AND METHOD OF USE

(71) Applicant: Phillip T. Olandese, Arlington, TX (US)

(72) Inventor: Phillip T. Olandese, Arlington, TX (US)

( * ) Notice: Subject to any disclaimer, the term of this patent is extended or adjusted under 35 U.S.C. 154(b) by 0 days.

(21) Appl. No.: 16/175,722

(22) Filed: Oct. 30, 2018

(65) Prior Publication Data

US 2019/0127951 A1 May 2, 2019

Related U.S. Application Data

(60) Provisional application No. 62/578,856, filed on Oct. 30, 2017.

(51) Int. Cl.

| | |
|---|---|
| ***E02F 7/06*** | (2006.01) |
| ***E02F 7/02*** | (2006.01) |
| ***E02F 3/407*** | (2006.01) |
| ***B07B 4/08*** | (2006.01) |
| ***B07B 13/04*** | (2006.01) |
| ***B07B 1/16*** | (2006.01) |
| ***B07B 13/16*** | (2006.01) |
| ***B07B 1/00*** | (2006.01) |
| ***B07B 1/12*** | (2006.01) |
| ***B07B 1/46*** | (2006.01) |

(52) U.S. Cl.

CPC ..... *E02F 7/06* (2013.01); *B07B 1/005* (2013.01); *B07B 1/12* (2013.01); *B07B 1/16* (2013.01); *B07B 1/4636* (2013.01); *B07B 4/08* (2013.01); *B07B 13/04* (2013.01); *B07B 13/16* (2013.01); *E02F 3/407* (2013.01); *E02F 7/026* (2013.01); *B07B 2201/04* (2013.01)

(58) Field of Classification Search

CPC ..... E02F 5/226; E02F 7/00; E02F 7/06; E02F 7/026; E02F 3/407; B07B 1/005; B07B 1/12; B07B 1/16; B07B 4/08; B07B 13/04; B07B 2201/04

USPC ..... 209/262, 418, 419, 420, 421

See application file for complete search history.

(56) References Cited

U.S. PATENT DOCUMENTS

| | | | | |
|---|---|---|---|---|
| 3,380,604 A * | 4/1968 | Leese | E02F 3/407 414/694 |
| 5,241,764 A * | 9/1993 | Modig | E02F 3/407 37/405 |
| 8,905,688 B1 * | 12/2014 | Moore | B23B 29/027 408/102 |
| 2002/0098032 A1 * | 7/2002 | Nye | E02F 3/364 403/31 |

* cited by examiner

*Primary Examiner* — Terrell H Matthews
(74) *Attorney, Agent, or Firm* — Richard Eldredge

(57) ABSTRACT

A sediment classification system enables the screening of material that enters a backhoe bucket. Material that enters the bucket exits through a duct with an opening at the back of the bucket. The material is screened by passing between a first set of bars and a second set of bars. The bars have spacers between them attached to one of the sets of bars. The second set of bars is pined to the first set and is able to move to clear material wedged between the bars.

1 Claim, 4 Drawing Sheets

SEDIMENT CLASSIFICATION SYSTEM AND METHOD OF USE

BACKGROUND

1. Field of the Invention

The present invention relates generally to mineral extraction systems, and more specifically, to a sediment classification system for selecting which size material is allowed to enter the system and be collected.

2. Description of Related Art

Mineral extraction systems are well known in the art and are effective means to gather material from the earth and remove the desired ore from the surrounding matrix. For example, FIG. 1 depicts a conventional backhoe apparatus 101 having a bucket 103 hydrolically attached to and activated by an arm 105. The arm being attached to and controlled from a tractor 107. During use, the backhoe 101 is positioned near a stream or river and the bucket is used to scoop or shovel material into a container for sorting. The material is then sorted and the desired ore is extracted.

One of the problems commonly associated with apparatus 101 is its limited efficiency. For example, when sediment is mixed with water it is difficult to gather because it is able to run out as the bucket is pulled up causing losses of up to 80% of the amount of dry sediment that could be collected by the same bucket.

Additionally when collecting material from a body of water it is the finer material that is desired as the water has had time to help extract the ore from the rocks. The backhoe apparatus 101 is unable to select what type of material is collected further reducing its efficiency.

Accordingly, although great strides have been made in the area of backhoe apparatuses, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

FIGS. 3A and 3B are cross-sectional top views of the bars of FIG. 2 in the retracted and extended positions respectively.

Figure 1:
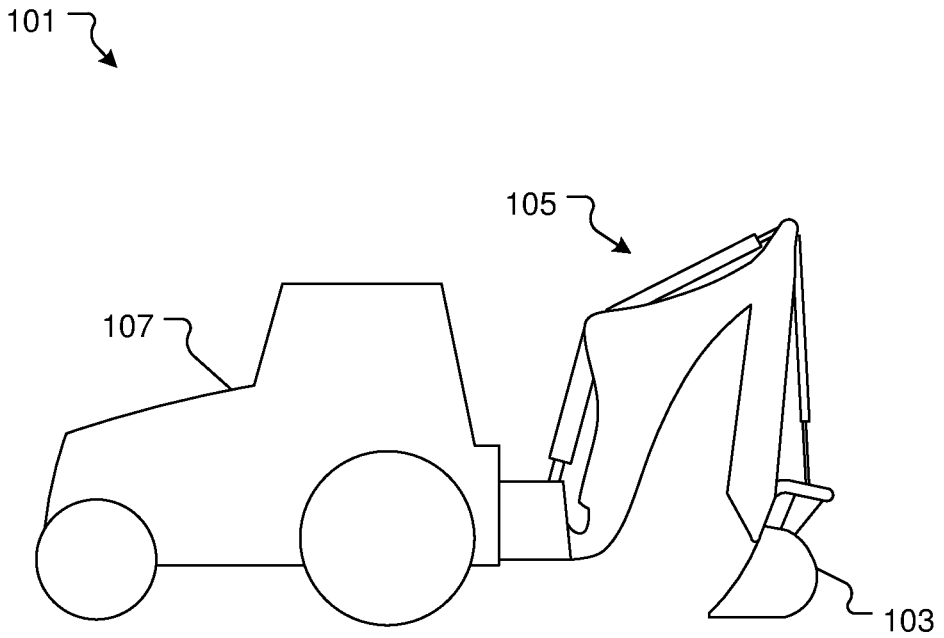
FIG. 1 is a side view of a common backhoe apparatus.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional backhoe apparatuses. Specifically, the invention of the present application enables the collection of nearly all of the material that enters the bucket. In addition, the material entering the bucket is classified to collect only the finer material. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
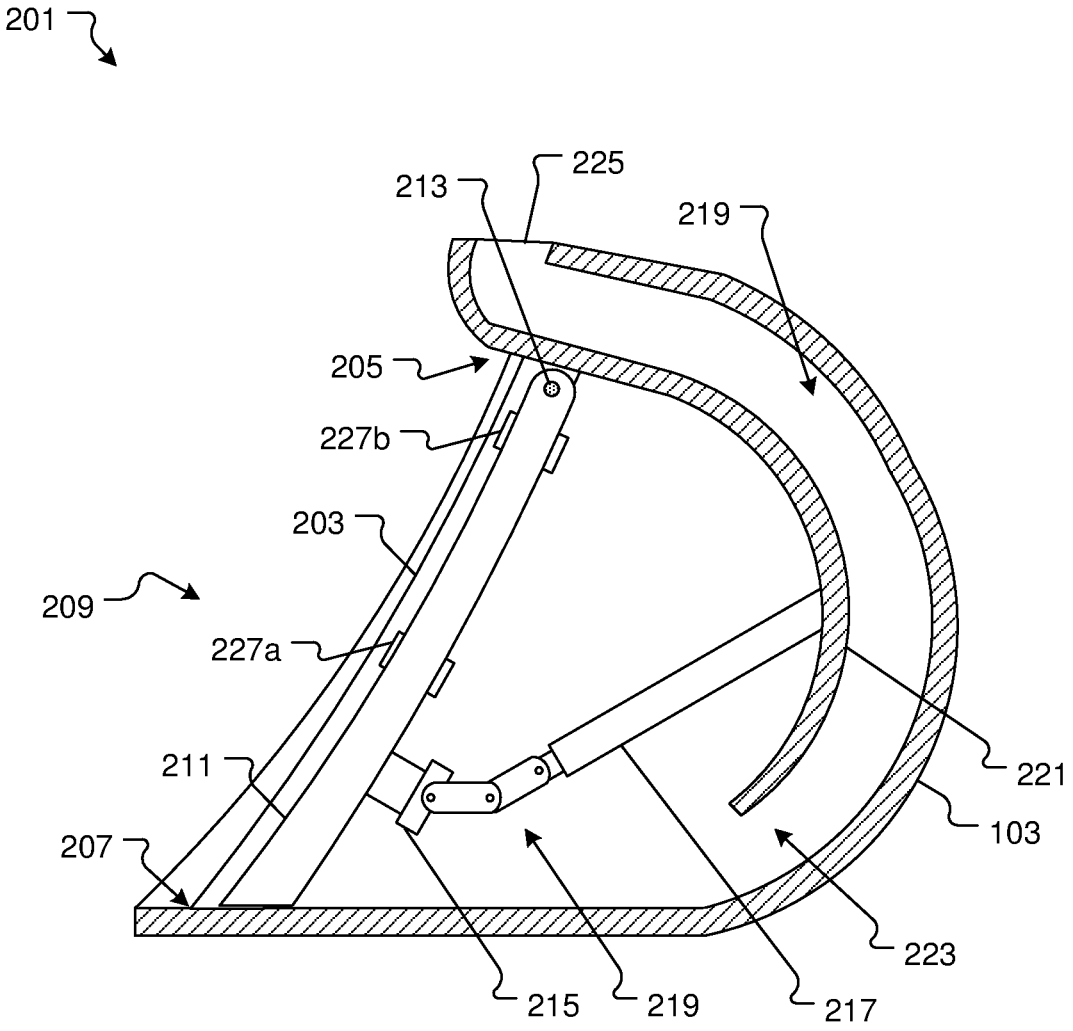
FIG. 2 is a cross-sectional side view of a sediment classification system in accordance with a preferred embodiment of the present application.

Referring now to the drawings wherein like reference characters identify corresponding or similar elements throughout the several views, FIG. 2 depicts a cross-sectional side view of a sediment classification system in accordance with a preferred embodiment of the present application. It will be appreciated that system 201 overcomes one of more of the above-listed problems commonly associated with conventional backhoe apparatuses.

In the contemplated embodiment, system 201 includes a backhoe bucket 103 having a first set of bars 203 rigidly attached at the top 205 and bottom 207 ends near the mouth 209 of the bucket 103. A second set of bars 211 is pivotally attached to the first set 203 near the top 205 via a rod 213. The second set of bars 211 being positioned away from the mouth 209 more than the first set of bars 203.

Figure 3A:
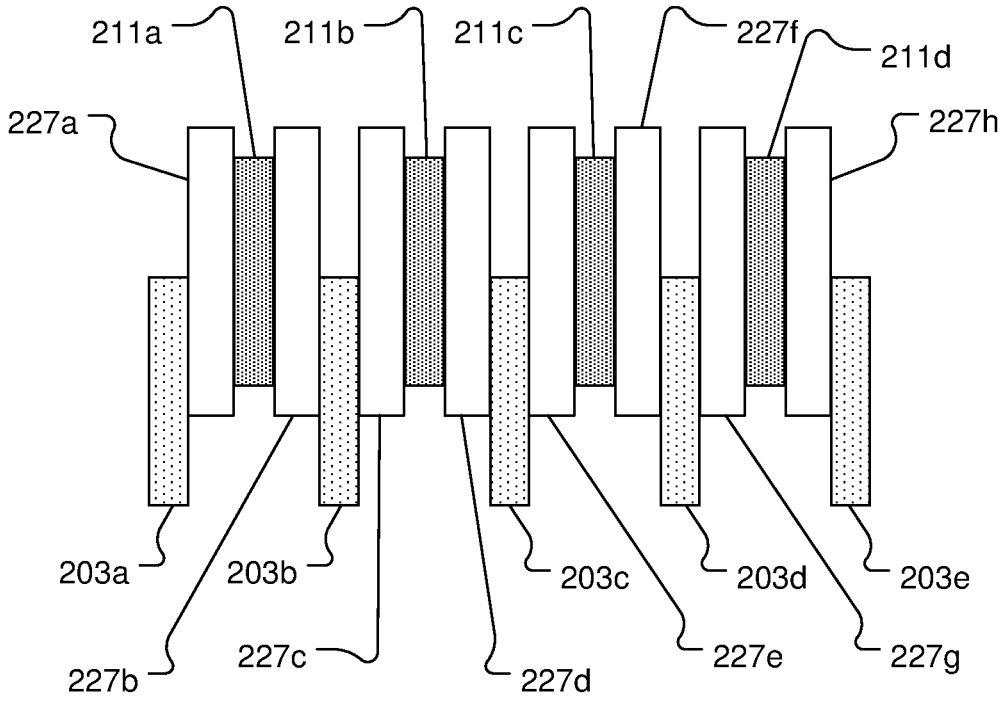
Figure 3A:
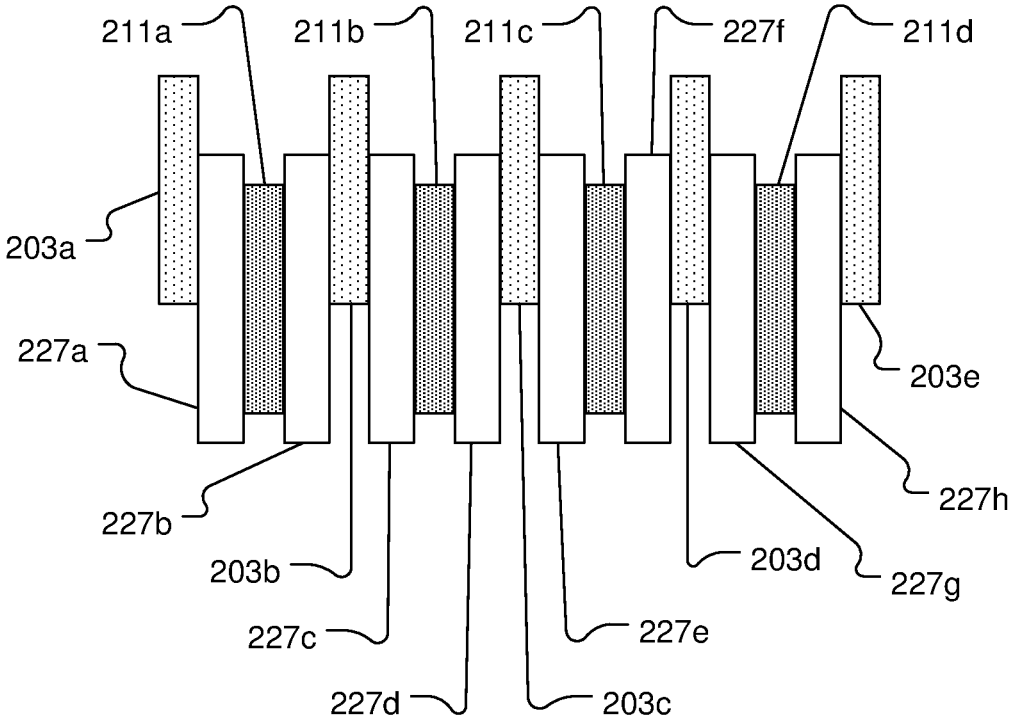

The second set of bars 211 are rigidly attached together by a support bar 215. Force is applied to the support bar 215 via a piston 217 and linkage 219 causing the second set of bars 211 to move towards the mouth 209 of the bucket until the second set 211 is in front of the first set of bars 203 as depicted by FIGS. 3A and 3B respectively. The second set of bars 211 moves to dislodge material that is stuck between the bars 203, 211. The position of the first set of bars 203 with respect to the second set of bars 211 is maintained by spacers 227 attached to the second set of bars 211 in the space between them.

The back 219 of the bucket 103 has a duct 221 rigidly attached thereto with an opening 223 near the bottom 207. The top 225 of the duct 221 is attached to a suction source and is configured to pull material from the bucket to a collection site.

It should be appreciated that one of the unique features believed characteristic of the present application is that the material entering bucket 103 must pass between the first set of bars 203 and the second set of bars 211 limiting the size of the material that can enter.

Another unique feature believed characteristic of the present application is that the material collected by the bucket 103 is transferred to a collection site without removing the bucket 103 from the water, preventing the loss of collected material. It will be appreciated that the suction source and duct 221 enable the capture of almost all the material that enters the bucket 103.

Figure 4:
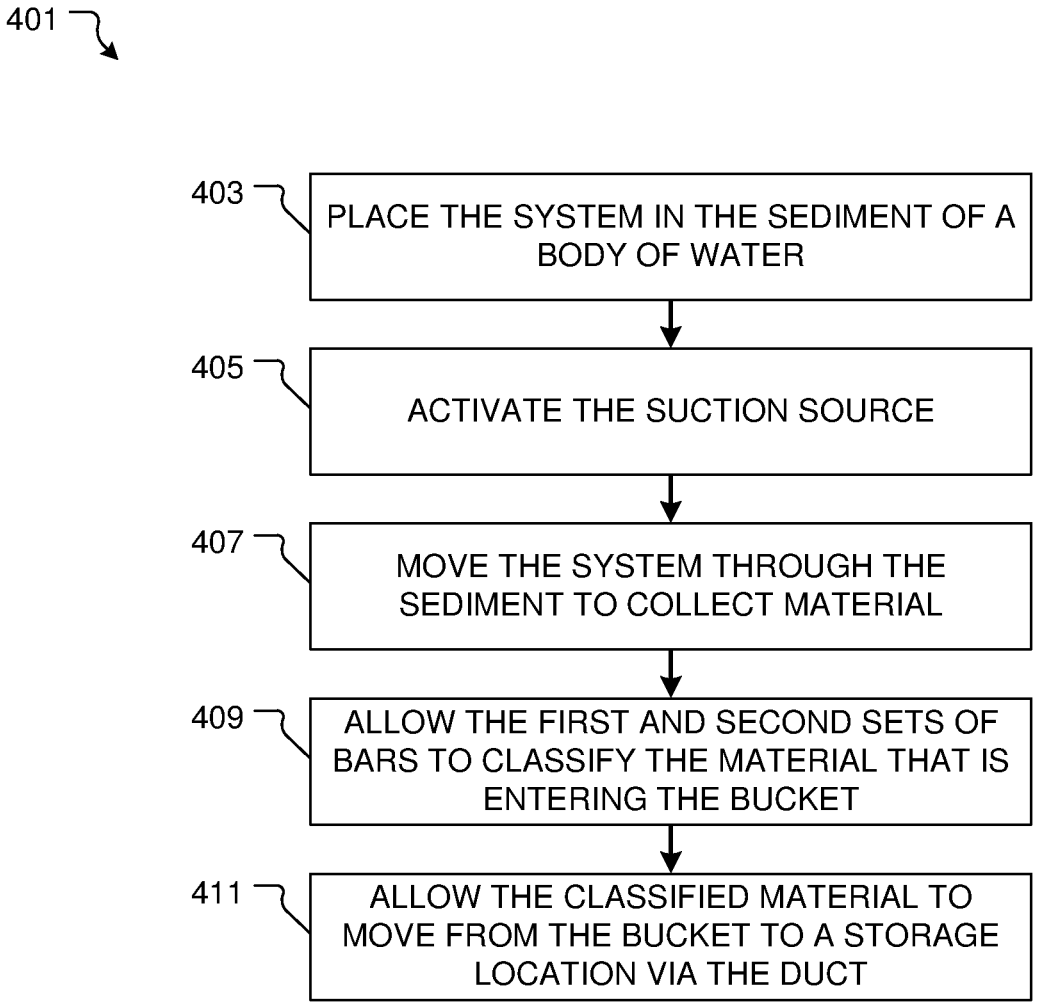
FIG. 4 is a flowchart of the preferred method of use of the system of FIG. 2.

Referring now to FIG. 4 the preferred method of use of the system 201 is depicted. Method 401 including placing the system in the sediment of a body of water 403, activating the suction source 405, moving the system through the sediment causing material to enter the bucket 407, allowing the first and second sets of bars to classify the material entering 409 and allowing the classified material to move from the bucket through the duct and to a storage location 411.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A sediment classification system comprising:

a backhoe bucket having a duct at a back of the bucket; the duct being in fluid communication with a suction source;

a first set of bars rigidly attached at the top to the duct and at the bottom;

a second set of bars pivotally attached to the first set of bars near the top;

the second set of bars being attached to each other by a support bar;

a plurality of spacers attached to at least one set of bars configured to prevent deflection of the bars while in use; and a piston and linkage configured to move the second set of bars towards a mouth of the bucket;

wherein the first and second sets of bars limit the size of material that enters the bucket; and wherein the material exits the bucket via the duct and suction source.

* * * * *